US006595297B2

(12) United States Patent
Dallas

(10) Patent No.: US 6,595,297 B2
(45) Date of Patent: Jul. 22, 2003

(54) METHOD AND APPARATUS FOR INSERTING A TUBING HANGER INTO A LIVE WELL

(76) Inventor: L. Murray Dallas, 790 River Oaks Dr., Fairview, TX (US) 75069

( * ) Notice: Subject to any disclaimer, the term of this patent is extended or adjusted under 35 U.S.C. 154(b) by 1 day.

(21) Appl. No.: 09/791,980

(22) Filed: Feb. 23, 2001

(65) Prior Publication Data

US 2002/0117308 A1 Aug. 29, 2002

(51) Int. Cl.[7] ..... E21B 19/08
(52) U.S. Cl. ..... 166/382; 166/77.4; 166/85.4
(58) Field of Search ..... 166/337, 348, 166/368, 382, 77.4, 77.53, 85.4

(56) References Cited

U.S. PATENT DOCUMENTS

| | | | | |
|---|---|---|---|---|
| 4,241,786 A | | 12/1980 | Bullen | 166/77 |
| 4,632,183 A | | 12/1986 | McLeod | 166/85 |
| 4,867,243 A | | 9/1989 | Garner et al. | 66/379 |
| 4,940,095 A | | 7/1990 | Newman | 166/378 |
| 5,012,865 A | | 5/1991 | McLeod | 166/90 |
| 5,103,900 A | | 4/1992 | McLeod et al. | 166/88 |
| 5,785,121 A | | 7/1998 | Dallas | 166/90.1 |
| 5,819,851 A | | 10/1998 | Dallas | 166/308 |
| 5,988,274 A | * | 11/1999 | Funk | 166/77.4 |
| 6,009,941 A | | 1/2000 | Haynes | 166/72 |
| 6,019,175 A | | 2/2000 | Haynes | 166/382 |
| 6,145,596 A | | 11/2000 | Dallas | 166/379 |
| 6,179,053 B1 | | 1/2001 | Dallas | 166/77.51 |
| 6,209,633 B1 | | 4/2001 | Haynes | 166/72 |
| 6,220,363 B1 | | 4/2001 | Dallas | 166/382 |
| 6,234,253 B1 | | 5/2001 | Dallas | 166/377 |
| 6,247,537 B1 | | 6/2001 | Dallas | 166/379 |
| 6,289,993 B1 | | 9/2001 | Dallas | 166/386 |
| 6,364,024 B1 | | 4/2002 | Dallas | 166/379 |
| 6,447,021 B1 | | 9/2002 | Haynes | 285/302 |

OTHER PUBLICATIONS

Two pages printed from website of Hydril Company.
Patent application serial No. 09/537,629 entitled "Blowout Preventer Protector and Method of Using Same," filed Mar. 29, 2000.
Patent application serial No. 09/780,190 entitled "Seal Assembly for Dual String Coil Tubing Injection and Method of Use," filed Feb. 8, 2001.

* cited by examiner

*Primary Examiner*—William Neuder
(74) *Attorney, Agent, or Firm*—Nelson Mullins Riley & Scarborough, LLP

(57) ABSTRACT

Apparatus for inserting a tubing hanger into a tubing head spool on a live well includes a landing spool and a landing joint that reciprocates through a top end of the landing spool. The landing joint is connected to the tubing hanger. The landing spool is connected to a top flange of a blowout preventer on the live well. The blowout preventer is then opened and the tubing hanger is injected into the tubing head spool. A lifting spool is also provided to permit the tubing hanger to be injected without the use of a service rig. Safety is improved, costs reduced and production is facilitated because the well does not have to be killed.

35 Claims, 6 Drawing Sheets

METHOD AND APPARATUS FOR INSERTING A TUBING HANGER INTO A LIVE WELL

CROSS-REFERENCE TO RELATED APPLICATIONS

This is the first application filed for the present invention.

MICROFICHE APPENDIX

Not Applicable.

TECHNICAL FIELD

The present invention relates in general to methods and apparatus for installing wellhead equipment in live wells, and, in particular, to a method and apparatus for inserting a tubing hanger into a tubing head spool installed on a live well.

BACKGROUND OF THE INVENTION

Production tubing is commonly used in oil wells for production purposes after an oil well has been completed or recompleted. Wells are frequently stimulated during the completion and recompletion processes. During well stimulation, high pressure fluids are pumped at high rates into one or more production zones of the well in order to fracture the hydrocarbon bearing formations to release trapped hydrocarbons. After the well has been completed or recompleted, fluid pressures in the well are typically greater than atmospheric pressure, and must be contained in order to prevent the loss of hydrocarbons to atmosphere.

In many cases, after a well is stimulated, well operators prefer to prepare the well for production without "killing" the well. A well is killed by pumping overbearing fluids into the well to contain fluid pressures in the well. Killing the well is generally considered undesirable because the kill fluids can potentially hinder production by disturbing the affects of the well treatment procedure. Consequently, production tubing is generally run into the live well using injection methods that are well known in the art. When the production tubing is run into a live well, a retrievable plug is first inserted into the bottom end of the tubing. This prevents hydrocarbons from escaping through the production tubing as it is run into the well. Jointed tubing or coil tubing may be used for production. In either case, tubing rams on blowout preventers (BOPs) are used to seal around the tubing while the tubing is being run into the well. If jointed tubing is used, the tubing is generally run through a snubbing unit, as is well understood in the art.

After the production tubing string has been run into the well, however, a tubing hanger must be set in the tubing head spool to suspend the production tubing string in the well. The tubing hanger is connected to a top end of the tubing string, and special equipment is required to run the tubing hanger into the tubing spool.

FIG. 1 is a schematic diagram of equipment that is frequently used to install a tubing hanger on a live well, generally indicated by reference 10. The live well includes a casing spool 12, to which a tubing head spool 14 is mounted. Tubing head spool 14 generally includes one or more tubing head valves 16, which communicate with an annulus of the well in a manner well known in the art. Mounted to a top of the tubing head spool is a ram-type blowout preventer (BOP) 18 having a set of opposed tubing rams 20, which are used to close an annulus of the well bore around a production tubing of a known diameter, and a set of opposed blind rams 22 which are used to completely block the annulus but cannot be used to close around tubing or other components. Mounted to the top of the ram-type BOP is an annular BOP 24, available, for example, from Hydril Company, Houston, Tex. The annular BOP 24 employs a flexible rubber packing unit to provide pressure seal-off at the wellhead. The annular BOP can contain annulus pressure on an open hole or around tubular elements inserted into the well, such as production tubing 30 and tubing hanger 32. The production tubing 30 and the tubing hanger 32 are inserted into the well using a landing joint 34 controlled by blocks 36 of a service rig, the remainder of which is not shown. Service rigs are well known in the art.

The paired BOPs shown in FIG. 1 are capable of sealing around the production tubing 30, a tubing collar (not shown), the tubing hanger 32, and the landing joint 34 as they are respectively run into the live well bore. These respective components run through the BOPs to the tubing head spool 14 in the order specified. The landing joint 34 is screwed into a top of the tubing hanger 32 and is connected to the blocks 36 of the service rig. The respective components are then stepped through the BOPs 24, 18 as the pipe rams 20 and the annular BOP 24 are opened and closed in sequence to permit the tubing hanger to be inserted into the tubing head spool while the live well is under pressure. Although this procedure is known to work reliably and has been approved by regulatory authorities, it has several disadvantages. First, the respective BOPs 18, 24 add significantly to the height over the well, thus making the floor of the rig (not shown) very high and a potentially dangerous place to work. Furthermore, in certain jurisdictions safety laws require that a completion rig be moved away from the well before and during a well stimulation treatment, in order to provide adequate working space in the case of emergency. After well stimulation is completed, the rig must be moved back over the well, usually for the sole purpose of landing the tubing hanger and installing the wellhead after the tubing hanger has been landed in the live well. This is a costly operation, and it would be more cost-effective and beneficial if the well operator were able to release the service rig after the tubing is run into the well, to clear valuable work area and to reduce expense by releasing the service rig as early as possible.

Consequently, there exists a need for a method and apparatus for setting a tubing hanger in a tubing head spool on a live well which is easier and more cost-effective than the known method described above.

SUMMARY OF THE INVENTION

It is an object of the invention to provide an apparatus for setting a tubing hanger in a tubing head spool on a subterranean well in which a fluid pressure in the well is greater than atmospheric pressure.

It is a further object of the invention to provide a method of setting a tubing hanger in a tubing head spool on a subterranean well in which a fluid pressure in the well is greater than atmospheric pressure.

It is yet a further object of the invention to provide a method and apparatus for setting a tubing hanger in a tubing head spool on a live well without the use of a service rig.

The invention therefore provides an apparatus for setting a tubing hanger in a tubing head spool in a subterranean well in which a fluid pressure is greater than atmospheric pressure. Such wells are commonly referred to as "live wells". The apparatus comprises a landing spool which is mounted to a ram-type blowout preventer (BOP). The BOP is in turn mounted to the tubing head spool. The landing spool includes a flange for sealing attachment to the BOP and a top end through which a landing joint is reciprocated. The top end of the landing spool provides a high-pressure seal to prevent an escape of hydrocarbons as all the landing joint is reciprocated therethrough. A sidewall of the landing spool preferably includes a pressure bleed port to permit an equalization of pressure between the landing spool and the well, or an equalization of pressure between the landing spool and atmosphere. Lifting hooks or eyes are also provided on the sidewall of the landing spool, to permit the connection of flexible members, such as chains or cables, to support the landing spool before it is connected to a top flange of the BOP.

The top end of the landing spool through which the landing joint is reciprocated includes a packing cavity that receives high-pressure packing, such as Chevron packing. The high-pressure packing is retained in the packing cavity by a packing nut, such as a gland nut, well known in the art. The packing nut is preferably reinforced by a safety nut that engages a threaded outer perimeter of the top end of the landing spool. The safety nut has an inwardly-extending top wall that closely surrounds the landing joint and covers the gland nut to ensure that the high-pressure packing is not ejected by fluid pressures in the live well.

In accordance with a further embodiment of the invention, the apparatus further includes a lifting spool adapted to be mounted between the landing spool and the BOP. The lifting spool includes a bottom flange adapted to be mounted to a top of the BOP and a top flange to which the landing spool is mounted. Both the top and bottom flanges of the lifting spool are adapted to accommodate high-pressure gaskets to provide a high-pressure fluid seal between adjacent components. The lifting spool includes at least two attachment points for the connection of lift mechanisms for supporting and vertically displacing a lifting beam to which a top end of the landing joint is connected. By actuating the lift mechanisms, the landing joint and the attached tubing hanger and production tubing string may be lifted to release slips supporting the tubing, or lowered to inject the tubing hanger into the tubing spool. The lift mechanisms are preferably hydraulic cylinders, although other lift mechanisms such as ball jacks, or the like, may be used. The attachment points are, for example, slots formed in a top of respective lift arms of the lifting spool. Transverse bores pierce the slots. The slots receive mounting lugs which are likewise pierced by a transverse bore. Pins pass through the transverse bores in the lift arms and the mounting lugs to secure the lift mechanisms to the lifting spool.

The lifting beam is attached to the rams to support the landing joint as described above. The landing joint is preferably connected to the lift beam by a swivel joint or a hydraulic motor. If a swivel joint is used, the landing joint may be rotated using a wrench, to connect the landing joint to a top of the tubing hanger, as well as to swivel the production tubing if a downhole packer, hanger, plug or some other downhole attachment must be set. A hydraulic motor is used for the same purpose and is beneficial if the well is deep and long runs of tubing must be manipulated in order to seat a downhole packer, or the like.

The lifting beam preferably further includes pulleys, winches or come-alongs mounted adjacent the lift mechanisms. The pulleys, winches or come-alongs control the cables or chains used to support the landing spool before it is connected to a top flange of the lifting spool. After the landing joint is connected to the tubing hanger and slips supporting the tubing are removed, the landing spool is lowered, using the pulleys, winches or come-alongs, onto a top flange of the lifting spool and the landing spool is connected to the lifting spool to provide a fluid-tight seal around the landing joint.

The invention further provides a method of setting a tubing hanger in a tubing head spool of a subterranean well in which a fluid pressure in the well is higher than atmospheric pressure. The method comprises steps of supporting a plugged tubing string run into the well through a BOP. The tubing string is supported using slips to inhibit the tubing string from falling into the well, so that a tubing hanger can be connected to a top end of the tubing string. The landing spool and landing joint are hoisted into vertical alignment with the tubing hanger and the landing joint is connected to the tubing hanger. A lift mechanism is connected to a top end of the landing joint and the landing joint and the tubing string are raised to free the slips. After the slips are removed, the tubing hanger is lowered into a top of the BOP and the landing spool is lowered and connected to a top flange of the BOP. Fluid pressure between an annulus of the well and the landing spool is equalized. Fluid pressure is equalized using, for example, a bleed hose connected between a valve on the tubing head spool and a bleed port on the landing spool. After pressure is equalized, pipe rams on the BOP are opened and the tubing hanger is injected into the tubing head spool. Lockdown nuts on the tubing head spool are used to lock the tubing hanger in the tubing head spool and the landing joint is disconnected from the tubing hanger. The landing joint is then withdrawn and blind rams on the BOP are closed. Thereafter, pressure is bled from the landing spool and the landing spool is removed. Once the tubing hanger is secured in the tubing head spool, the BOP can be removed from the well. A wellhead can then be mounted to the tubing head spool in order to complete preparation of the well for production of hydrocarbons.

Thereafter, pressure between the wellhead and the annulus of the well can be equalized and the plug in the bottom end of the tubing removed using, for example, a wireline run down through the production tubing.

The invention further provides a method of installing a tubing hanger in a tubing head spool in a well in which fluid pressure exceeds atmospheric pressure without the use of a service rig. In accordance with the method, a lifting spool is mounted to a top of a BOP that is mounted above a tubing head spool of the live well. A plugged tubing is run into the well through the lifting spool on the BOP. The plugged tubing is supported with slips at a top flange of the lifting spool to inhibit the tubing string from falling into the well. A landing spool with a landing joint and lift mechanisms adapted for connection to the lifting spool are hoisted into vertical alignment with the tubing hanger. The lift mechanisms are connected to the lifting spool and the landing joint is connected to the tubing hanger. The lift mechanisms are actuated to lift the tubing hanger to release the slips. The slips are removed and the tubing hanger is lowered into the lifting spool. The landing spool is then lowered and sealingly connected to a top of the lifting spool. Pressure is equalized between an annulus of the well and the lifting spool. Thereafter, the BOPs are opened and the lift mechanisms are actuated to lower the tubing hanger into the tubing head spool.

After the tubing hanger has been lowered into the tubing head spool, the tubing hanger is locked in the tubing head spool using the lockdown screws. The landing joint is then disconnected from the tubing hanger and raised above blind rams of the BOPs. The blind rams are closed, pressure is bled from the landing spool and the landing spool and the lifting spool are removed from the wellhead along with the lift mechanisms. Thereafter, the BOPs may be removed and a wellhead installed as described above.

DESCRIPTION OF THE DRAWINGS

The invention will now be explained by way of example only, and with reference to the following drawings, in which.

It will be noted that throughout the appended drawings, like features are identified by like reference numerals.

DETAILED DESCRIPTION OF THE PREFERRED EMBODIMENTS

This invention provides apparatus and methods for setting a tubing hanger into a tubing head spool of a live well without the use of multiple blowout preventers and, optionally, without the use of a service rig.

Figure 1:
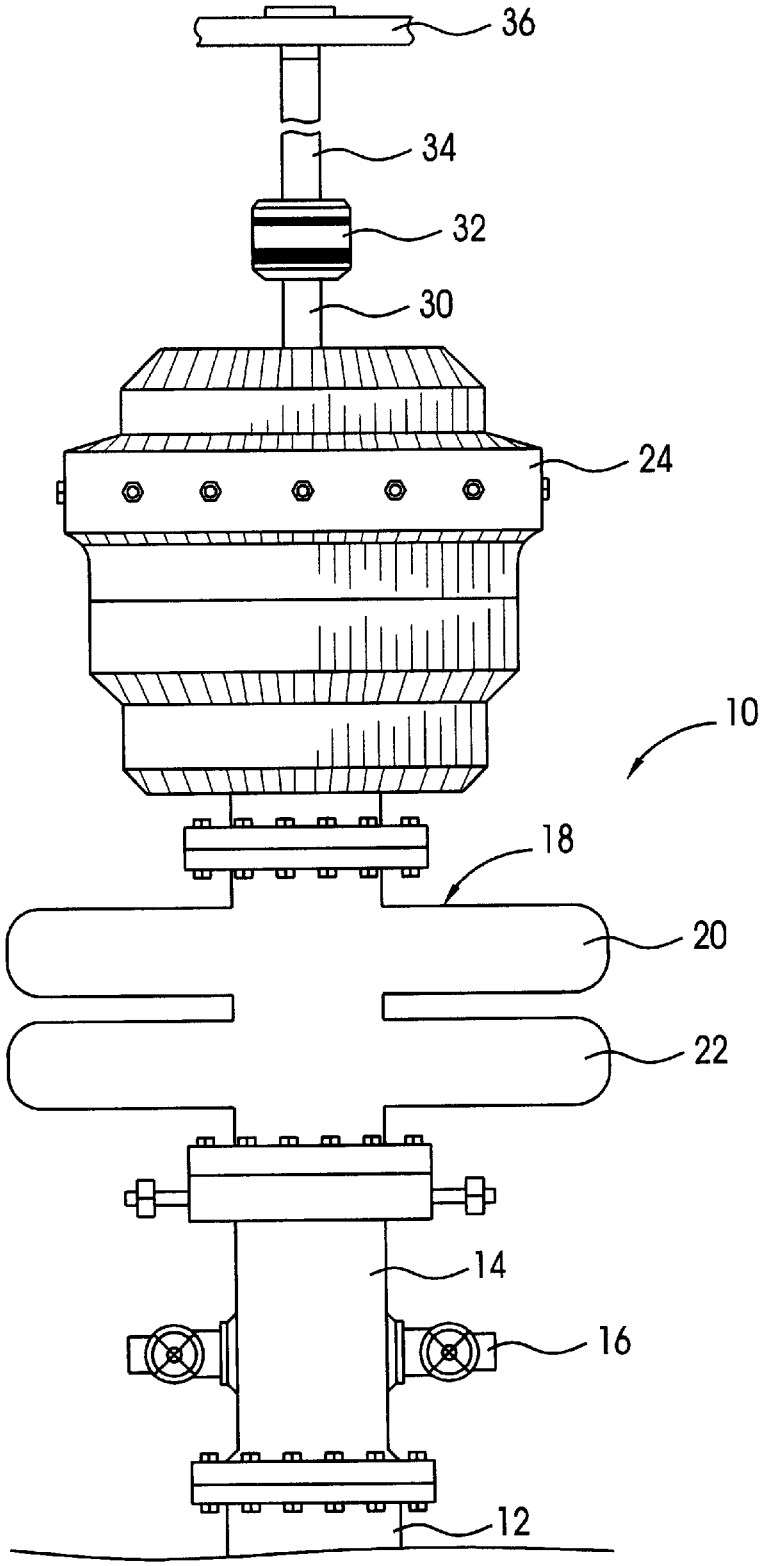
FIG. 1 Prior Art
FIG. 1 is a schematic elevational view of a prior art arrangement of BOPs used to inject a tubing hanger into a tubing head spool of a live well.
Figure 2A:
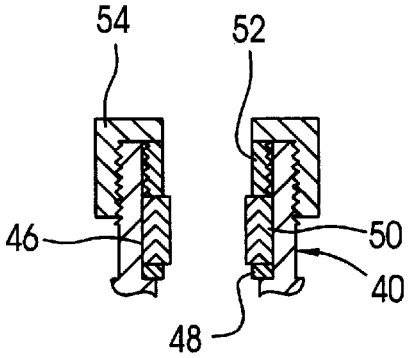
FIG. 2*a* is a detailed schematic view of a fluid seal provided between the landing spool shown in FIG. 2 and a landing joint that reciprocates through a passage in a top end of the landing spool.
Figure 2:
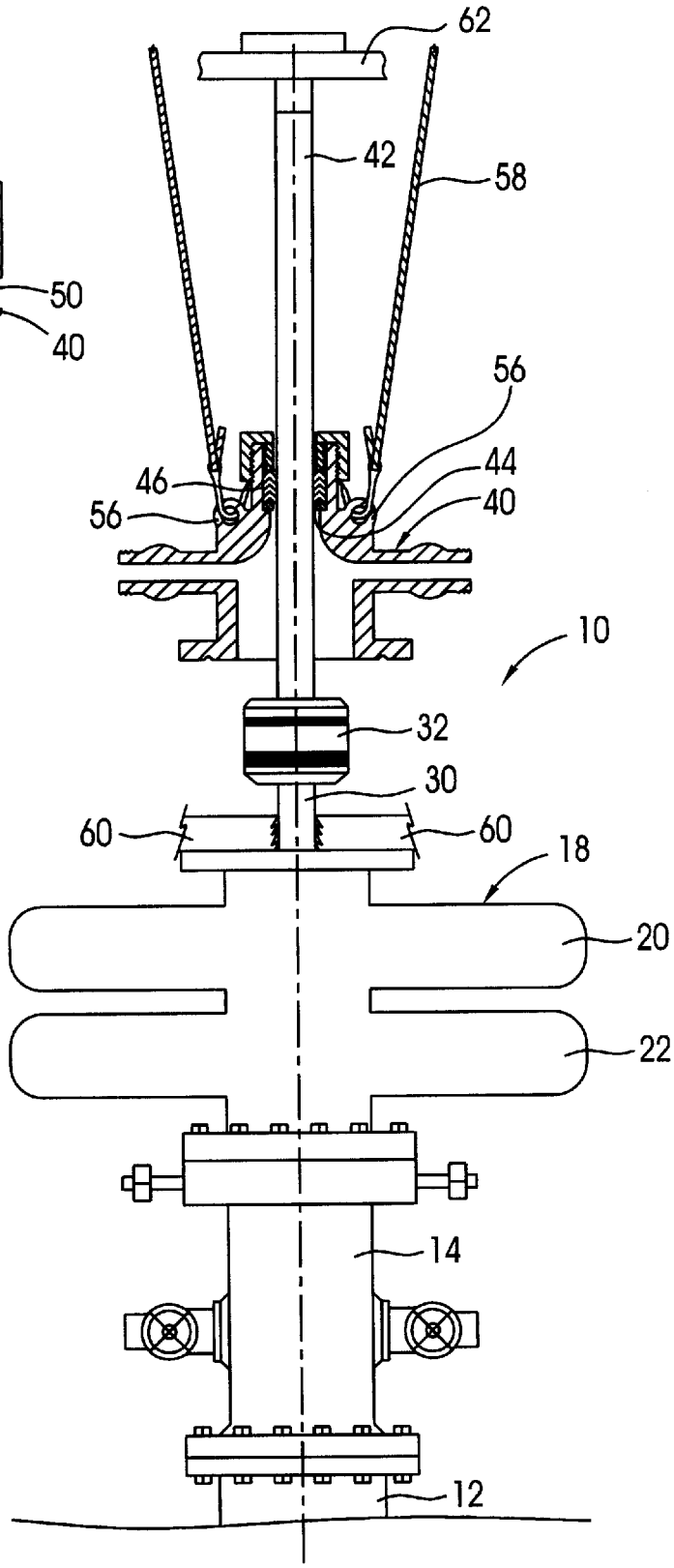
FIG. 2 is a schematic elevational view of a live well with a production tubing supported by slips at a top of a BOP, showing a landing spool in accordance with the invention in cross-section.

FIG. 2 is a schematic elevational view of a live well 10 which includes a casing spool 12 to which a tubing header spool 14 is mounted. Mounted to a top of the tubing header spool 14 is a ram-type BOP 18, which is well known in the art. The BOP 18 includes tubing rams 20 and blind rams 22. As is well known in the art, the tubing rams may be equipped with tubing slips to accommodate jointed or coiled tubing of different diameters. The blind rams 22 are used to seal an annulus of the well in the event that a production tubing string 30 is dropped into the well.

As is well understood in the art, the completion of a well for production includes a step of perforating a casing of the well to permit hydrocarbons to flow into an annulus of the well from production zones (not shown). Completion of the well also frequently includes stimulation procedures in which high-pressure fluids are pumped down through the tubing string 30 and/or the well casing to stimulate production zones prior to placing the well into productive service. Subsequent to stimulation, may well operators prefer to inject tubing into the live well without flowing drilling mud, or the like, into the well to "kill" the well, in order to ensure that kill fluids do not reverse any of the benefits of the stimulation process. As is well understood, however, a tubing hanger cannot be safely inserted through a single BOP mounted to a live well.

The apparatus in accordance with the invention permits a tubing hanger to be rapidly and safely inserted into a tubing head spool of a live well using only one BOP. The apparatus in accordance with the invention includes a landing spool, generally indicated by the reference 40, and a landing joint 42 which is connected to a top end of the tubing hanger 32. A bottom of the landing joint 42 is preferably machined with an "EUE" thread for this purpose. The landing joint 42 is inserted through a passage 44 in a top end of the landing spool 40. The passage 44 includes a packing cavity 46.

The packing cavity 46 is shown in more detail in FIG. 2*a*. The packing cavity 46 retains a steel packing washer 48 over which a high-pressure packing 50, such as a Chevron packing, is positioned. The packing 50 closely surrounds and provides a high-pressure seal around the landing joint 42 to ensure that well fluids do not escape to atmosphere when the tubing hanger 32 is inserted into the tubing head spool 14. The high-pressure packing 50 is retained in the packing cavity 46 by a gland nut 52. A safety nut 54 threadedly engages a spiral thread on a outer periphery of the top end of the landing spool 40. A top wall of the safety nut 54 projects inwardly to cover the gland nut 52 to ensure that the gland nut 52 is not stripped by fluid pressures exerted on the high-pressure packing 50. A sidewall of the landing spool 40 includes at least two eyes or hooks 56. The eyes or hooks 56 receive chain or cable 58 used to suspend the landing spool 40 while the landing joint 42 is connected to a top end of the tubing hanger 32. The landing spool 40 is also suspended while slips 60, well known in the art, that suspend the production tubing 30 are removed to permit the tubing hanger 32 to be inserted down through the BOP 18. The landing joint 42 is typically supported by blocks 62 of a service rig (not shown). The slips 60 are likewise generally slips of the service rig.

Figure 3:
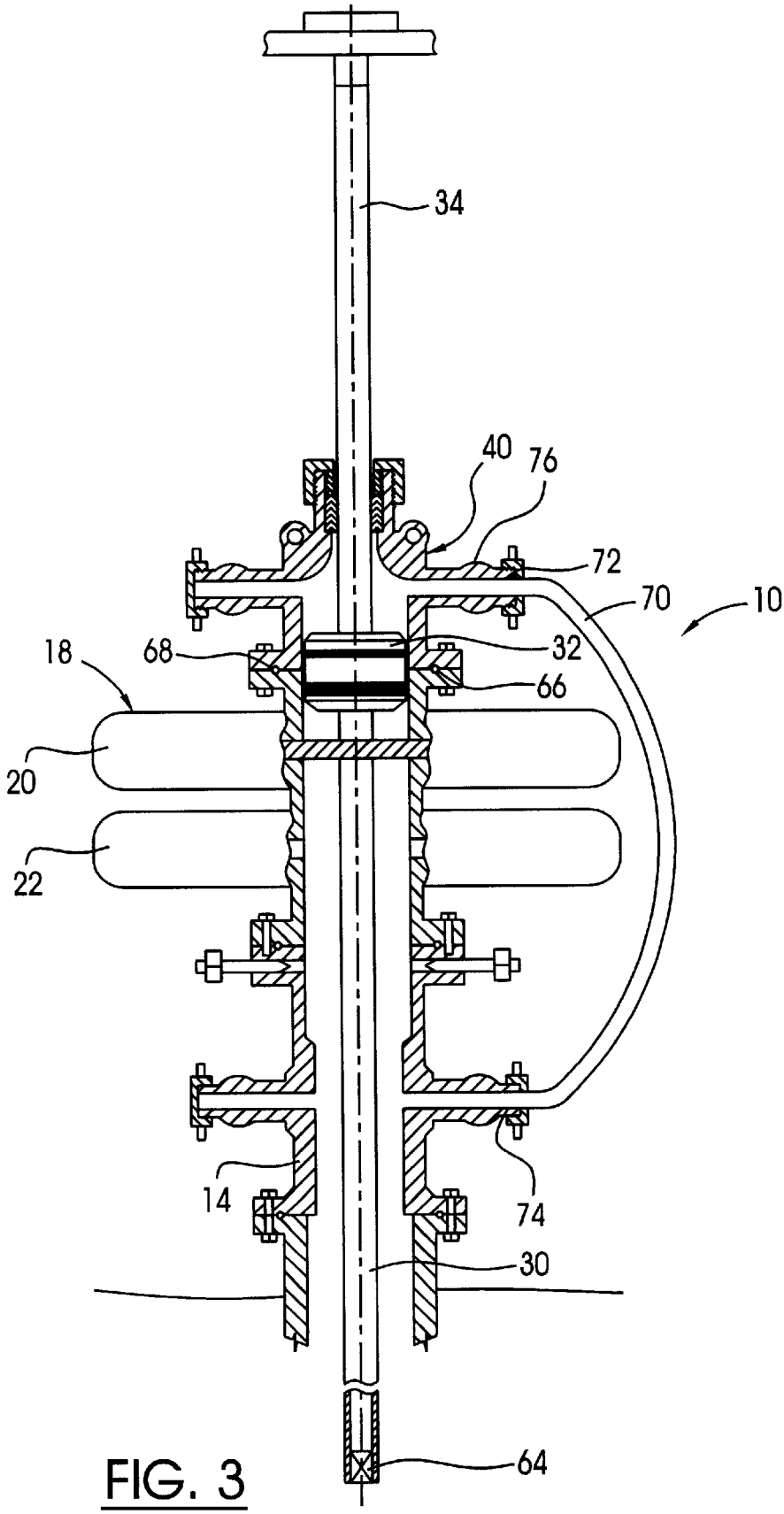
FIG. 3 is a cross-sectional view of the live well shown in FIG. 2, illustrating pressure equalization between an annulus of the well and the landing spool in accordance with the invention.

After the landing joint 42 is connected to a top end of the tubing hanger 32, the blocks 62 are operated to bear the weight of the production tubing 30 and the slips 60 are removed. Thereafter, the landing joint 42 is lowered to lower the tubing hanger 32 into a top of the BOP 18, as shown in FIG. 3. As will be noted, the tubing ram 20 of the BOP 18 is closed around the production tubing 30. As is also well understood by those skilled in the art, a bottom of the production tubing 30 is sealed by a retrievable plug 64, which prevents well fluids from escaping through an open end of the tubing string 30. After the slips 60 are removed and the tubing hanger 32 is lowered, the cables 58, connected, for example, to a sand line of the service rig, are used to lower the landing spool 40 onto a top flange of the BOP 18. A high-pressure gasket 66 is inserted into a ring gasket groove 68 provided in the respective flanges of the landing spool 40 and the BOP 18 to provide a high-pressure fluid seal between those components.

Figure 4:
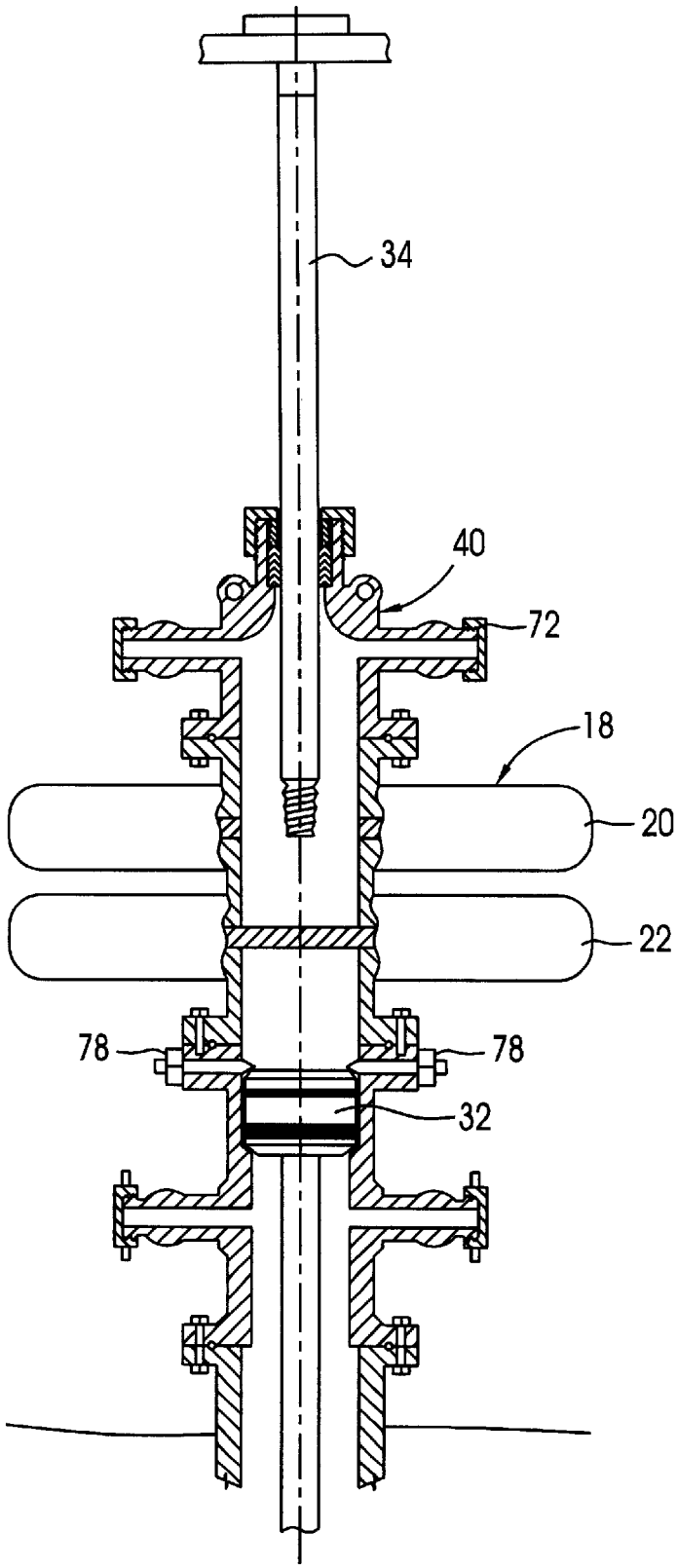
FIG. 4 is a cross-sectional view of the live well shown in FIG. 3 with the tubing hanger installed in the tubing head spool, the landing joint disconnected from the tubing hanger and the blind rams of the BOP in a closed condition.

After the landing spool 40 is mounted to the BOP 18, pressure is equalized between an annulus of the live well and the landing spool 40. A pressure bleed hose 70 is connected between a pressure bleed port 72 on the landing spool and a corresponding port or valve 74 in fluid communication with an annulus of the live well 10 to permit fluid pressure to equalize between the annulus and the landing spool 10. After the pressure is equalized and it has been verified that there are no leaks at the ring gasket 66 or the high-pressure packing 50, the respective valves are closed and the bleed hose 70 may be removed, as shown in FIG. 4. Thereafter, the tubing rams 20 are opened which opens the annulus through the BOP 18 to permit the tubing hanger 32 to be lowered into the tubing head spool 14, as shown in FIG. 4. After the tubing hanger is seated in the tubing head spool, lock bolts 78 of the tubing head spool 14 are adjusted to lock the tubing hanger 32 in the tubing head spool.

The landing joint 34 is then rotated to disconnect the landing joint from the tubing hanger 32, and the landing joint is raised until it is above the blind rams 22 of the BOP 18. After the blind rams are closed, pressure is vented from the landing spool 40 by, for example, opening the pressure bleed port 72. Subsequently, the landing spool is removed by, for example, reconnecting the cables 58 to the eyes 56 (see FIG. 2) and removing the landing spool using the sand line of the service rig. Once the landing spool is removed, the BOP 18 can be removed from the tubing head spool. Thereafter, a wellhead (not shown) can be mounted to the tubing head spool 14 using methods well known in the art. Pressure between the wellhead and the annulus beneath the tubing hanger 32 is balanced using a pressure bleed hose 70 as described above. A wireline lubricator (not shown) or the like may be used to run a wireline into the hole to remove the plug 64 (FIG. 3) sealing the bottom end of the production tubing 30. After the plug 64 is removed, production from the well can commence.

Figure 5:
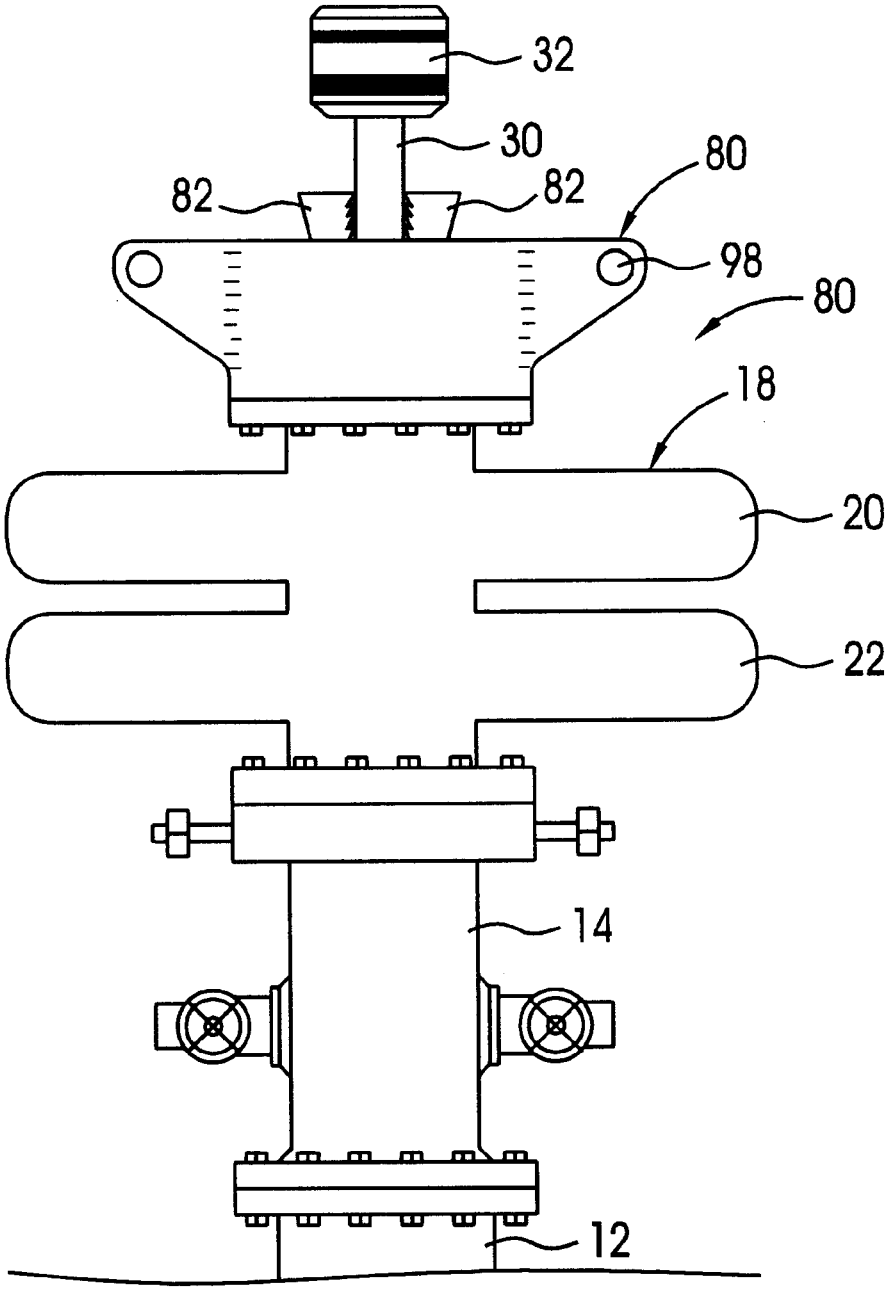
FIG. 5 is a schematic elevational view of a lifting spool in accordance with a further aspect of the invention.

FIG. 5 is a schematic view of a lifting spool that may be used in conjunction with the apparatus, in accordance with a further aspect of the invention. The lifting spool 80 is mounted to a BOP on a live well 10. The lifting spool 80 permits the tubing hanger 32 to be inserted into the live well 10 without the use of a service rig. This has economic advantages by permitting the service rig to be released from the well as soon as the production tubing string 30 is run into the well, and before well stimulation is performed. In accordance with the invention, the lifting spool 80 is mounted to a top of the BOP 18 and the tubing string 30 is run into the well through an annulus of the lifting spool 80. Tubing string 30 is supported by slips 82, which are well known in the art. The service rig may then be released. After the service rig is released and the area is clear, the well may be stimulated using, for example, a blowout preventer protector as described in Applicant's U.S. Pat. No. 5,819,851, which issued on Oct. 13, 1998. The blowout preventer protector permits well stimulation fluids to be pumped down an annulus of the well, while the production tubing string 30 is used as a "dead string" to monitor fluid pressures in the stimulation zone. Alternatively, production tubing string 30 can also be used for the pumping of high-pressure stimulation fluids, for example, into a separate production zone to permit simultaneous stimulation of two production zones.

Figure 6:
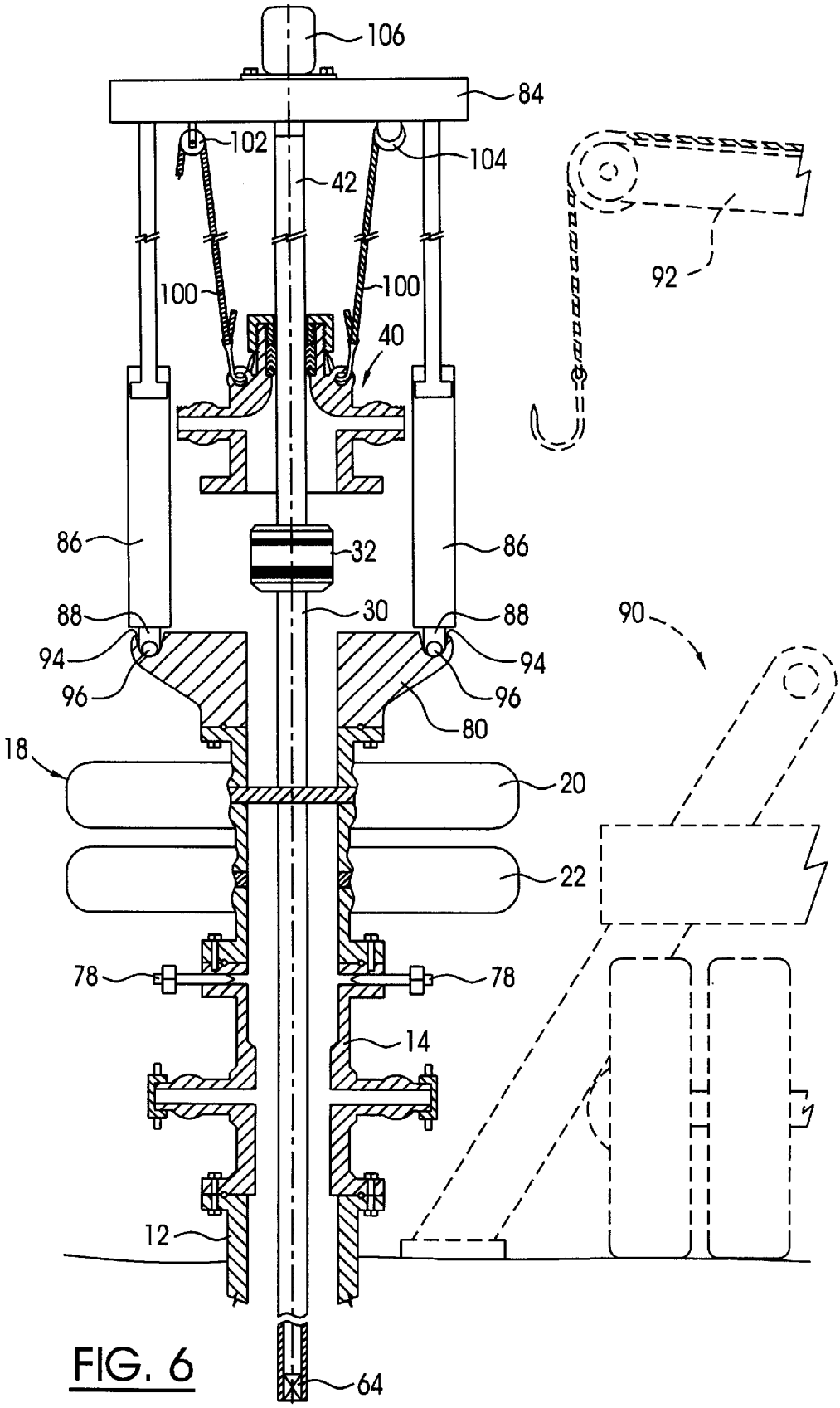
FIG. 6 is a cross-sectional view of the lifting spool shown in FIG. 5 with a lift mechanism connected to the lifting spool and the landing spool suspended above the tubing hanger in preparation for inserting the tubing hanger into the tubing head spool.

After the live well 10 has been stimulated and the fracturing stack or the blowout preventer protector (neither of which are shown) are removed from the lifting spool 80, a tubing hanger 32 is connected to a top of the tubing string 30. Thereafter, a lifting mechanism in accordance with this aspect of the invention is hoisted over the lifting spool 80 as shown in FIG. 6. Since the service rig has been released from the well, the lift mechanism is preferably hoisted into position using a boom truck 90, partially shown in ghost lines. A boom 92 of the boom truck is connected to the lift mechanism to hoist it in position over the lifting spool 80. The lift mechanism includes a lifting beam 84 supported by at least two lift rams 86 which are, for example, hydraulic cylinders, ball jacks, or the like. The lift rams 86 are connected to opposite ends of the lifting beam 84. The bottom ends of the lift rams 86 include mounting lugs 88 which are received in sockets 94 formed in the top of the lifting spool 80. Pins 96 are inserted through transverse bores 98 (FIG. 5) in sidewalls of the sockets 94 and corresponding bores through mounting lugs 88, to secure the lift rams 86 to the lifting spool 80.

The lifting beam 84 serves a dual function of supporting the landing spool 40 as well as the landing joint 34, which is used to raise and lower the production tubing string 30 connected to the tubing hanger 32. The landing spool 40 is preferably supported by flexible lifting members such as cables 100. The cables 100 are in turn supported by rotatable support members such as pulleys 102, or winches or come-alongs 104. The landing joint 42 may be connected at its top end to a hydraulic motor 106 to permit the production tubing string 30 to be rotated as required to set downhole attachments such as packers, plugs or hangers (not shown) connected to the production tubing string 30. After the lift mechanism shown in FIG. 6 is hoisted into position and locked in place using pins 96, the lift rams 86 are operated to lift the tubing string 30 to an extent required to free the slips 82 (FIG. 5). After the slips are removed, the tubing hanger 32 is lowered to an extent required to permit the landing spool 40 to be connected to a top of the lifting spool 80. Once the landing spool 40 is connected to a top of the lifting spool 80, pressure is equalized between the landing spool 40 and the annulus of the live well by connecting a bleed hose between the landing spool 40 and the tubing head spool 14, as shown in FIG. 3. After the pressure is equalized, tubing rams 20 of the BOP 18 are opened and the lift rams 86 are operated to lower the tubing hanger 32 into the tubing head spool 14, as shown in FIG. 4. The lock bolts 78 on the tubing head spool 14 are then adjusted to lock the tubing hanger 32 in the tubing head spool 14.

Thereafter, the landing joint 42 is disconnected from the top of the tubing hanger 32 and the landing joint 42 is raised until the bottom end is above the blind rams 22, which are closed as shown in FIG. 4. After the blind rams are closed, pressure is bled from the landing spool 40, the landing spool 40 is disconnected from the lifting spool 80 and the lift mechanism is removed from the lifting spool 80. The lifting spool 80 is then removed from the BOP 18. The BOP 18 may then be removed from the tubing head spool 14 after pressure is released, because the tubing hanger seals the annulus of the live well. After the BOP 18 is removed, the boom truck 90 can be used to hoist a wellhead (not shown) onto a top of the tubing head spool 14. After the wellhead is connected to a top of the tubing head spool 14, pressure is equalized between the wellhead and the annulus of the live well using a pressure bleed hose, in a manner similar to that shown in FIG. 3. Thereafter, a lubricator and a wireline, well known in the art, may be used to retrieve the retrievable plug 64 in the bottom end of the production tubing string 30 to enable production from the live well to commence.

The embodiments of the invention described above are intended to be exemplary only. The scope of the invention is therefore limited solely by the scope of the appended claims.

I claim:

1. Apparatus for setting a tubing hanger in a tubing head spool on a live well, comprising:

a) a landing spool for sealing attachment to a blowout preventer (BOP) mounted above the tubing head spool, the landing spool comprising a bottom flange adapted to be connected to a top flange of the BOP in a high-pressure fluid seal, a sidewall that includes a pressure bleed port, and a top end that includes an axial passage with a high-pressure seal for receiving and surrounding a landing joint to permit reciprocal movement of the landing joint through the landing spool; and b) the landing joint including a top end adapted for connection to a lift mechanism and bottom end adapted for connection to the tubing hanger.

2. Apparatus as claimed in claim 1 wherein the sidewall of the landing spool further includes lifting eyes adapted for the connection of cables for lifting the landing spool and the landing joint into position for connecting the landing joint to the tubing hanger.

3. Apparatus as claimed in claim 1 wherein the top end of the landing spool further comprises a packing cavity surrounding a portion of the axial passage, the packing cavity receiving a high-pressure packing for providing the high-pressure seal around the landing joint.

4. Apparatus as claimed in claim 3 wherein the high-pressure packing is a chevron packing.

5. Apparatus as claimed in claim 3 wherein the high-pressure packing is retained in the packing cavity by a gland nut received in a threaded top end of the packing cavity.

6. Apparatus as claimed in 5 further comprising a safety nut that is secured to a spiral thread on an outer surface of the top end of the landing spool, the safety nut having a top flange that extends over the gland nut to ensure that the gland nut is not ejected by elevated fluid pressures acting on the high-pressure packing.

7. Apparatus as claimed in claim 1 further comprising a lifting spool adapted to be mounted between the landing spool and the BOP, the lifting spool including a bottom flange adapted for high-pressure fluid sealing attachment to a top of the BOP, and a top flange adapted for high pressure fluid sealing attachment to the bottom flange of the landing spool.

8. Apparatus as claimed in claim 7 wherein the lifting spool further includes at least two attachment points for the connection of lift mechanisms for supporting and vertically displacing a lifting beam that engages a top end of the landing joint for axially displacing the landing joint with respect to the lifting spool.

9. Apparatus as claimed in claim 8 wherein the lift mechanisms are hydraulic cylinders.

10. Apparatus as claimed in claim 9 wherein the attachment points are sockets, sidewalls of the sockets including transverse bores, and the hydraulic cylinders are connected to the sockets by mounting lugs that are received in the sockets and respective pins that pass through the transverse bores in the respective sidewalls, and through respective bores in the lugs.

11. Apparatus as claimed in claim 8 wherein the lifting beam further includes a swivel for connecting the lifting beam to the top end of the landing joint, to permit the landing joint to be rotated while it is connected to the lifting beam.

12. Apparatus as claimed in claim 8 wherein the lifting beam further includes a hydraulic motor for rotating a member connecting the lifting beam to a top end of the landing joint, the hydraulic motor being used to rotate the landing joint and a tubing string connected to the landing joint, to set a downhole packer, plug or hanger, if required.

13. Apparatus for setting a tubing hanger in a tubing head spool on a live well, comprising:

a) a lifting spool adapted to be mounted to a blowout preventer (BOP) mounted above the tubing head spool, and further adapted to provide a high-pressure fluid seal when mounted to the BOP, the lifting spool including at least two attachment points for the connection of a lift mechanism used to raise and lower the tubing string;

b) a landing spool adapted to be mounted to the lifting spool, and to provide a high-pressure fluid seal with the lifting spool; and c) a landing joint reciprocally movable through a high-pressure fluid seal provided at a top end of the landing spool, the landing joint including a top end adapted for connection to the lift mechanism and a bottom end adapted for connection to the tubing hanger.

14. Apparatus as claimed in claim 13 wherein the lift mechanism comprises:

a) at least two rams that may be extended or retracted under a load induced by the tubing string; and b) a lifting beam supported by the at least two rams, the lifting beam including a connection mechanism for removable connection of the landing joint.

15. Apparatus as claimed in claim 14 wherein the rams are hydraulic cylinders.

16. Apparatus as claimed in claim 15 wherein the hydraulic cylinders respectively include a connection lug affixed to a cylinder end, each connection lug being adapted to receive pins for connecting the hydraulic cylinder to one of the attachment points of the lifting spool.

17. Apparatus as claimed in claim 14 wherein the connection mechanism includes a swivel to permit axial rotation of the landing joint.

18. Apparatus as claimed in claim 14 wherein the connection mechanism is connected to a hydraulic motor to permit the landing joint to be axially rotated under hydraulic power.

19. Apparatus as claimed in claim 14 wherein the lifting beam further includes connectors adapted to receive cables for supporting the landing spool until the landing spool is connected to the lifting spool.

20. Apparatus as claimed in claim 19 wherein the connectors comprise pulleys for receiving the cables.

21. Apparatus as claimed in claim 19 wherein the connectors comprise winch drums.

22. Apparatus as claimed in claim 19 wherein the connectors comprise come-alongs.

23. A method of setting a tubing hanger in a tubing head spool of a live well, comprising steps of:

a) supporting a plugged tubing string, run into the well through a blowout preventer (BOP), using slips to inhibit the tubing string from falling into the well, so that a tubing hanger connected to a top end of the tubing string is supported above the BOP;

b) hoisting a landing spool with a landing joint into vertical alignment with the tubing hanger and connecting the landing joint to the tubing hanger;

c) lifting the landing joint and the tubing string to free the slips;

d) removing the slips and lowering the landing spool, and the landing joint if required, until the landing spool can be sealingly connected to a top flange of the BOP;

e) equalizing pressure between the subterranean well and the landing spool;

f) opening the BOP and running the tubing hanger into the tubing head spool;

g) securing the tubing hanger in the tubing head spool;

h) disconnecting the landing joint from the tubing hanger, and withdrawing the landing joint from the BOP; and i) closing the BOP, bleeding off pressure from the landing spool and removing the landing spool from the BOP.

24. A method as claimed in claim 23 wherein the step of equalizing pressure between the subterranean well and the landing spool comprises steps connecting a bleed hose to a first bleed port on the landing spool and a second bleed port on the tubing head spool, and opening the respective first and second bleed ports.

25. A method as claimed in claim 23 further comprising a step of removing the BOP after the landing spool is removed.

26. A method as claimed in claim 25 further comprising a step of mounting a wellhead to the tubing head spool after the BOP is removed.

27. A method as claimed in claim 26 further comprising a step of equalizing fluid pressure between the subterranean well and the wellhead, and removing the plug from the plugged tubing string.

28. A method as claimed in claim 23 wherein the step of hoisting comprises a step of positioning a boom truck adjacent the well and using a boom on the boom truck for the hoisting.

29. A method of setting a tubing hanger in tubing head spool of a live well, comprising steps of:

a) mounting a lifting spool to a top of a blowout preventer (BOP) mounted above a tubing head spool of the well;

b) running a plugged tubing string into the well through the lifting spool and the BOP;

c) supporting the plugged tubing string with slips at a top flange of the lifting spool to inhibit the tubing string from falling into the well, so that a tubing hanger connected to a top end of the tubing string is supported above the lifting spool;

d) hoisting a landing spool with a landing joint and lift mechanisms adapted for connection to the lifting spool into vertical alignment with the tubing hanger;

e) connecting the landing joint to the tubing hanger, and connecting the lift mechanisms to attachment points on the lifting spool;

f) operating the lift mechanisms to lift the landing joint with the tubing string to free the slips;

g) removing the slips and lowering the landing spool, and the landing joint if required, until the landing spool can be sealingly connected to a top flange of the lifting spool;

j) equalizing pressure between the subterranean well and the landing spool;

k) opening the BOP and running the tubing hanger into the tubing head spool;

l) securing the tubing hanger in the tubing head spool;

m) disconnecting the landing joint from the tubing hanger, and withdrawing the landing joint from the BOP;

n) closing the BOP, bleeding off pressure from the landing spool and removing the landing spool from the lifting spool; and o) removing the lifting spool from the BOP.

30. A method as claimed in claim 29 further comprising a step of rotating the landing joint and the tubing string to set one of a packer, a plug and a tubing hanger connected to the tubing string.

31. A method as claimed in claim 30 wherein the step of rotating comprises rotating the landing joint using a hydraulic motor connected to a lifting beam used for supporting the landing joint and the tubing string.

32. A method as claimed in claim 29 further comprising a step of removing the BOP after the landing spool is removed.

33. A method as claimed in claim 32 further comprising a step of mounting a wellhead to the tubing head spool after the BOP is removed.

34. A method as claimed in claim 33 further comprising a step of equalizing fluid pressure between the live well and the wellhead.

35. A method as claimed in claim 34 further comprising a step of removing the plug from the plugged tubing string.

* * * * *